US006935210B2

(12) United States Patent
Hauk et al.

(10) Patent No.: US 6,935,210 B2
(45) Date of Patent: Aug. 30, 2005

(54) VARIABLE RACK ADJUSTMENT ASSEMBLY FOR PIPE SPINNING MACHINES

(75) Inventors: Thomas D Hauk, Palm Desert, CA (US); Raul Hector Perez, El Segundo, CA (US)

(73) Assignee: Hawk Industries, Inc., Long Beach, CA (US)

( * ) Notice: Subject to any disclaimer, the term of this patent is extended or adjusted under 35 U.S.C. 154(b) by 7 days.

(21) Appl. No.: 10/729,353

(22) Filed: Dec. 5, 2003

(65) Prior Publication Data

US 2005/0072274 A1 Apr. 7, 2005

Related U.S. Application Data

(63) Continuation-in-part of application No. 10/102,544, filed on Mar. 19, 2002, now Pat. No. 6,722,231.
(60) Provisional application No. 60/277,075, filed on Mar. 19, 2001.

(51) Int. Cl.[7] ..... B25B 13/50
(52) U.S. Cl. ..... 81/57.16; 81/57.17; 81/57.33
(58) Field of Search ..... 81/57.11–57.36

(56) References Cited

U.S. PATENT DOCUMENTS

| | | | | | |
|---|---|---|---|---|---|
| 2,460,671 | A | * | 2/1949 | Benedick | 414/756 |
| 2,862,690 | A | * | 12/1958 | Mason | 81/57.17 |
| 3,906,820 | A | * | 9/1975 | Hauk | 81/57.17 |
| 4,099,429 | A | * | 7/1978 | Hauk | 81/57.17 |
| 4,324,157 | A | * | 4/1982 | Soutsos | 81/57.17 |
| 4,512,216 | A | | 4/1985 | Callegari, Sr. et al. | |
| 4,604,922 | A | * | 8/1986 | Soutsos | 81/57.17 |
| 4,774,860 | A | | 10/1988 | Hawke | |
| 4,776,243 | A | | 10/1988 | Schulze-Beckinghausen et al. | |
| 4,843,924 | A | | 7/1989 | Hauk | |
| 5,060,542 | A | | 10/1991 | Hauk | |
| 5,386,746 | A | | 2/1995 | Hauk | |
| 5,868,045 | A | | 2/1999 | Hauk | |
| 6,206,096 | B1 | | 3/2001 | Belik | |
| 6,334,376 | B1 | | 1/2002 | Torres | |
| 6,460,634 | B1 | | 10/2002 | Hart et al. | |
| 6,505,531 | B2 | | 1/2003 | Stogner | |
| 6,722,231 | B2 | | 4/2004 | Hauk | |

OTHER PUBLICATIONS

Hawk Industries, Inc., Hawkjaw Operation, Maintenance and Service Manual Model 65K–MA, Apr. 1997, pp. 1–137, USA.

Hawk Industries, Inc., Hawkjaw Operation, Maintenance and Service Manual Model 100K–ALS, Rev 12.99.92.00, published circa Dec. 1999, pp. 1–159, USA.

* cited by examiner

*Primary Examiner*—David B. Thomas
(74) *Attorney, Agent, or Firm*—Squire, Sanders & Dempsey LLP

(57) ABSTRACT

A cam-operated, rack-on-rack adjustment assembly on a drill pipe spinner allows the user to easily and in small increments (distances) (three-eighths inch, one-quarter inch or less, or more) adjust the effective pipe engaging length of the drive chain. In other words, the effective length of chain wrap (the amount that grips the pipe) given the pipe size can be adjusted.

12 Claims, 16 Drawing Sheets

VARIABLE RACK ADJUSTMENT ASSEMBLY FOR PIPE SPINNING MACHINES

CROSS-REFERENCE TO RELATED APPLICATIONS

This is a continuation-in-part of application Ser. No. 10/102,544, filed Mar. 19, 2002, published on Dec. 5, 2002 as U.S. Pat. No. 6,722,231, and which claims the benefit of U.S. Provisional Application No. 60/277,075, filed Mar. 19, 2001, whose entire contents were incorporated by reference in the '544 application. The entire contents of these two applications and the publication are hereby incorporated by reference.

BACKGROUND OF THE INVENTION

A number of apparatuses or machines for making and breaking joints in drill pipe strings are known. A superior and commercially successful machine is the HAWKJAW apparatus available from Hawk Industries, Inc. of Long Beach, Calif. Versions of it are described in U.S. Pat. No. 5,060,542 (Hauk), U.S. Pat. No. 5,386,746 (Hauk), and U.S. Pat. No. 5,868,045 (Hauk). The HAWKJAW apparatus (or machine or power tong) including both the HAWKJAW JR. and SR. models, are disclosed in the "HAWKJAW Operation, Maintenance and Service Manual" (Model 100K-ALS-REV 12,99.9200) and "HAWKJAW Operation, Maintenance and Service Manual, Model 65K-ALS, June 2000." (The above-mentioned patents and publications and all other patents and publications mentioned anywhere in this disclosure are hereby incorporated by reference in their entireties.)

Also known in the prior art are different devices for spinning or rotating one pipe relative to another during the making or breaking of the threaded connection between them. An example of a commercially successful product is the SPINMASTER spinner also available from Hawk Industries. The SPINMASTER series of pipe spinners is available in air and hydraulic models, and include a unique gripping system. An example is the SPINMASTER Model 550/950 series, which is easy to maintain since it includes external mounted bearings with removable caps, cylinders pinned in position for simple removal and repair, and few moving parts. Another feature thereof is the high torque output because of the scissor case design with perpendicular mounted cylinders that increase the gripping force and because there is essentially no chain slippage. The chain is a heavy-duty, durable roller-type chain. The compact light design of this spinner makes it easy to be handled on the floor reducing crew fatigue. The basic function and construction of the SPINMASTER spinner are disclosed in U.S. Pat. No. 4,843,924 (Hauk).

In particular, the Hauk '924 patent discloses an apparatus for rotating a tubular well element about its longitudinal axis. First and second elongate casing sections are pivotally connected to each other at a pivot. First and second driven sprockets are mounted, respectively, on the casing sections at locations remote from the pivot. A drive sprocket, mounted on the first casing section, is driven by a motor-gear assembly. A continuous chain is mounted around the drive sprocket, and around the first and second driven sprockets, and has an inverse internal portion adapted to receive and directly contact the tubular well element to be rotated. Cylinders connected between the casing sections pivot them toward and away from each other and thus alternately clamp the inverse internal portion around the wall element, and release such element from the inverse internal portion. One end of each cylinder is pivotally connected to the first casing section at a point between the pivot and the first driven sprocket. The other end of each cylinder is pivotally connected to the second casing section at a point between the pivot and the second driven sprocket.

The chain for the spinner is periodically lubricated by the workmen by brushing it with grease. This is an ineffective lubricating method, however, since the grease does not get on the insides of the pins and the chains. Additionally, it is a separate labor step and the workmen may forget or procrastinate doing it. And it is especially important to keep the chain oiled in today's drilling environments, which are frequently subject to corroding salt water air. The linkages if not oiled will wear and rust quickly and bind.

SUMMARY OF THE INVENTION

A chain spinner of the present invention, which can be part of a make/break apparatus (such as the HAWKJAW apparatus) or a separate unit, is an improvement on the '924 patented design. The spinner, for example, can be a free hanging, separate stand alone unit. It can include a unique chain oiler system, which is powered by fluid passing through the spinner motor. When the spray button is pressed the nozzle sprays hydraulic fluid onto the moving chain. The oil can thus only be sprayed when the spinner motor is turning and the chain is moving. Additionally, a chain guide system can be provided for the spinner chain to prevent the chain from bunching up and catching on the sprockets, which is a serious problem in the prior art. This chain guide is another invention disclosed herein. These chain oilers and guides can be adapted to fit on today's spinners including the SPINMASTER spinner.

Further, an apparatus for rotating or spinning a tubular well element about its longitudinal axis is disclosed herein. A clam shell casing has first and second driven sprockets at its two ends. A drive sprocket engages and runs a continuous chain, which passes around both of the driven sprockets, and rotates a tubular well element (e.g., drill pipe) positioned generally between the driven sprockets. A unique cam-operated rack-on-rack adjustment assembly is operated by the user to move the drive sprocket relative to the driven sprockets to thereby adjust the effective length of the chain which contacts the tubular well element. The assembly can include stationary (gear teeth) racks and corresponding moving racks. As one embodiment, this apparatus can essentially be the '924 apparatus or the '887 publication apparatus with this adjustment assembly added.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

The SPINMASTER spinner can be used on pieces of equipment aside from the HAWKJAW apparatus; alternatively, it can hang on its own. When it is on its own, separate from the HAWKJAW apparatus, the controls and the system can be entirely hydraulic, without any pneumatic component. The spinner has to be running on the pipe and turning the pipe—that is, the spinner motor 70 pressurized—before the oil will spray on the chain 100 as described above in the "Summary of the Invention." That is, the motor pressure must be on, so as long as there is pressure to the spinner motor, the sprayer will work with the spray button pushed. If the apparatus is torqued up on the pipe and the spinner motor 70 stops and the connection is shouldered up but the motor has pressure to it, the sprayer will still spray.

Figure 1:
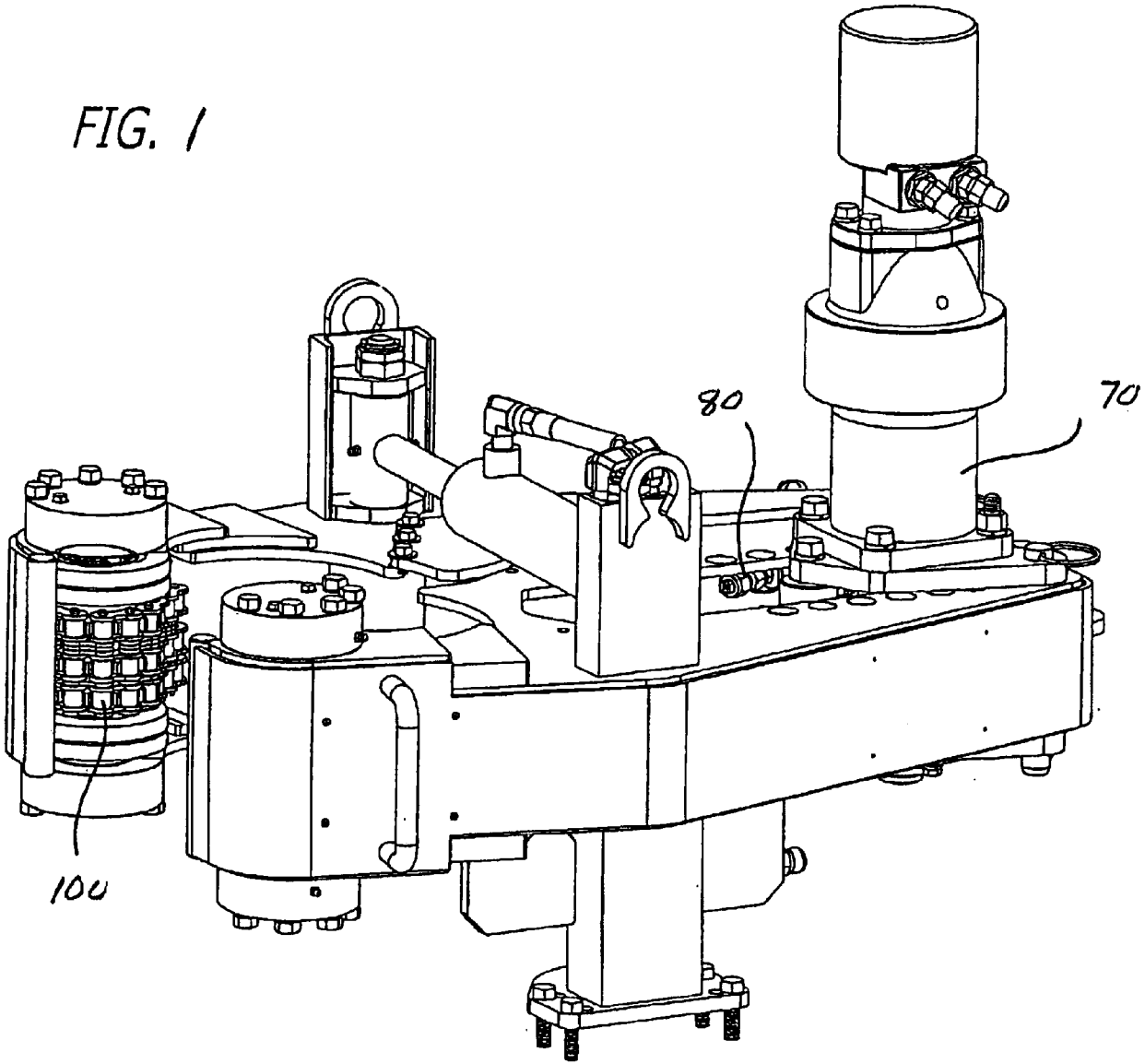
FIG. 1 is a perspective view of a chain spinner assembly of the present invention.
Figure 2:
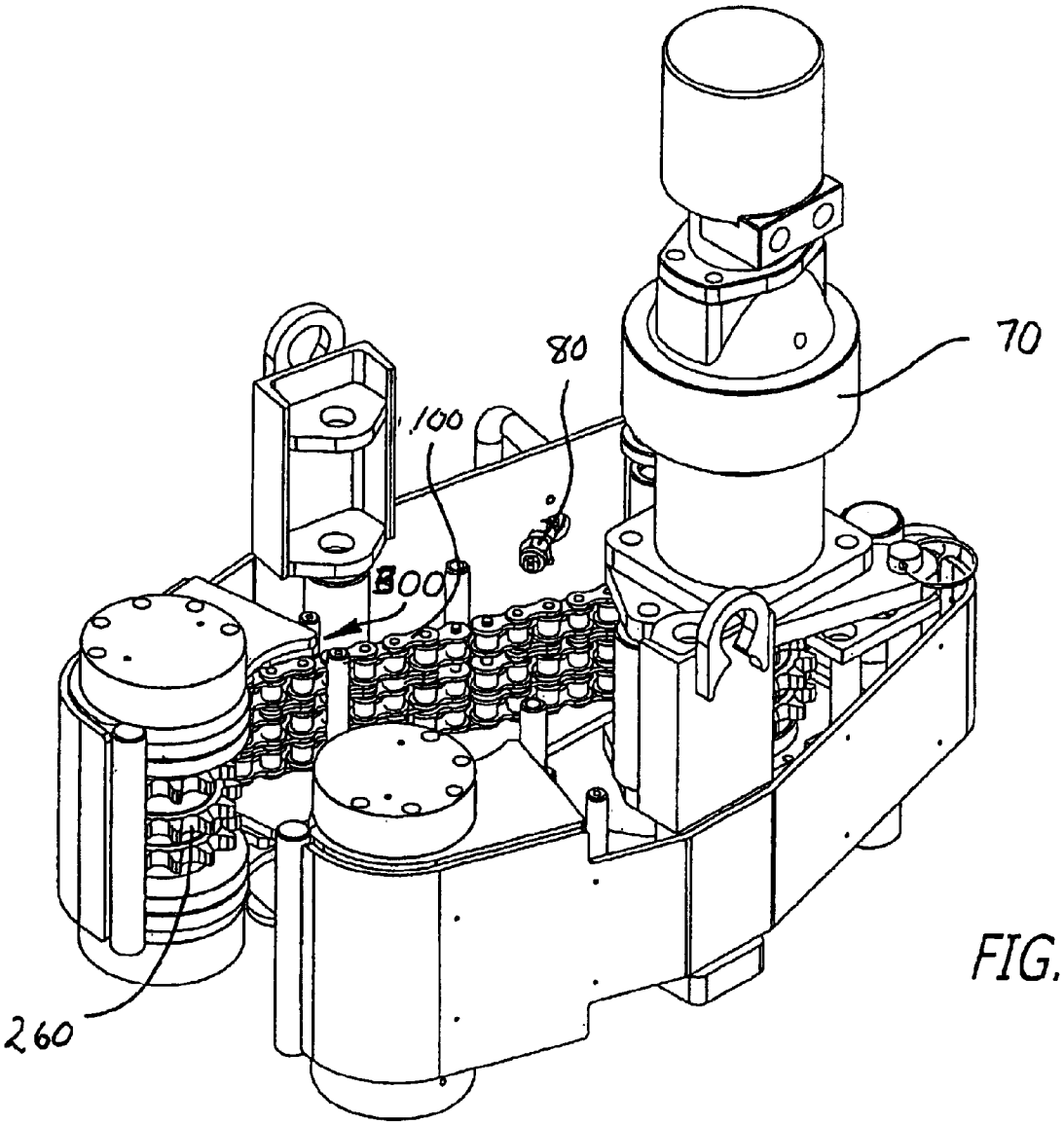
FIG. 2 is another (top) perspective view of the spinner of FIG. 1.
Figure 3:
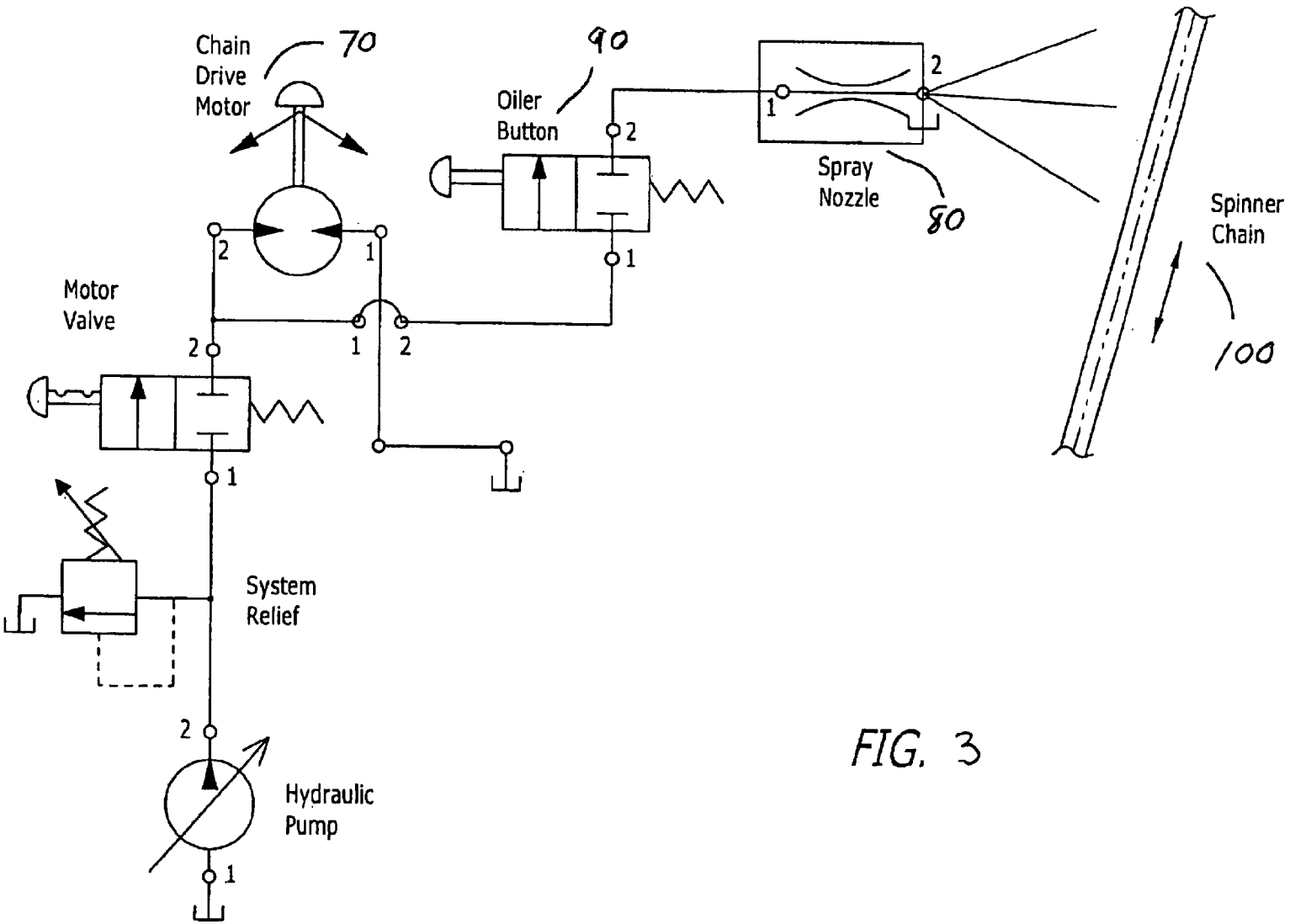
FIG. 3 is a hydraulic schematic of the spinner of FIG. 1.
Figure 4:
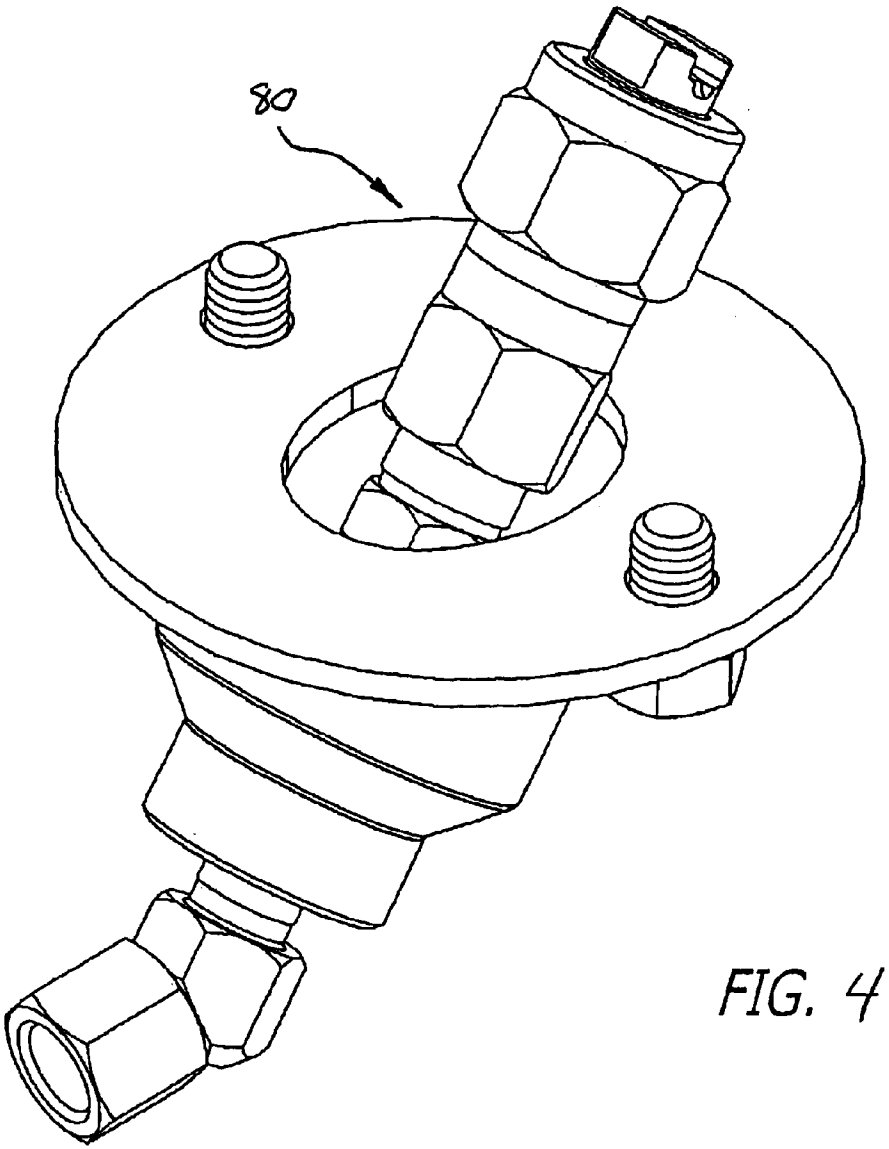
FIG. 4 is an enlarged view of the spray nozzle of the spinner of FIG. 2 shown in isolation.
Figure 5:
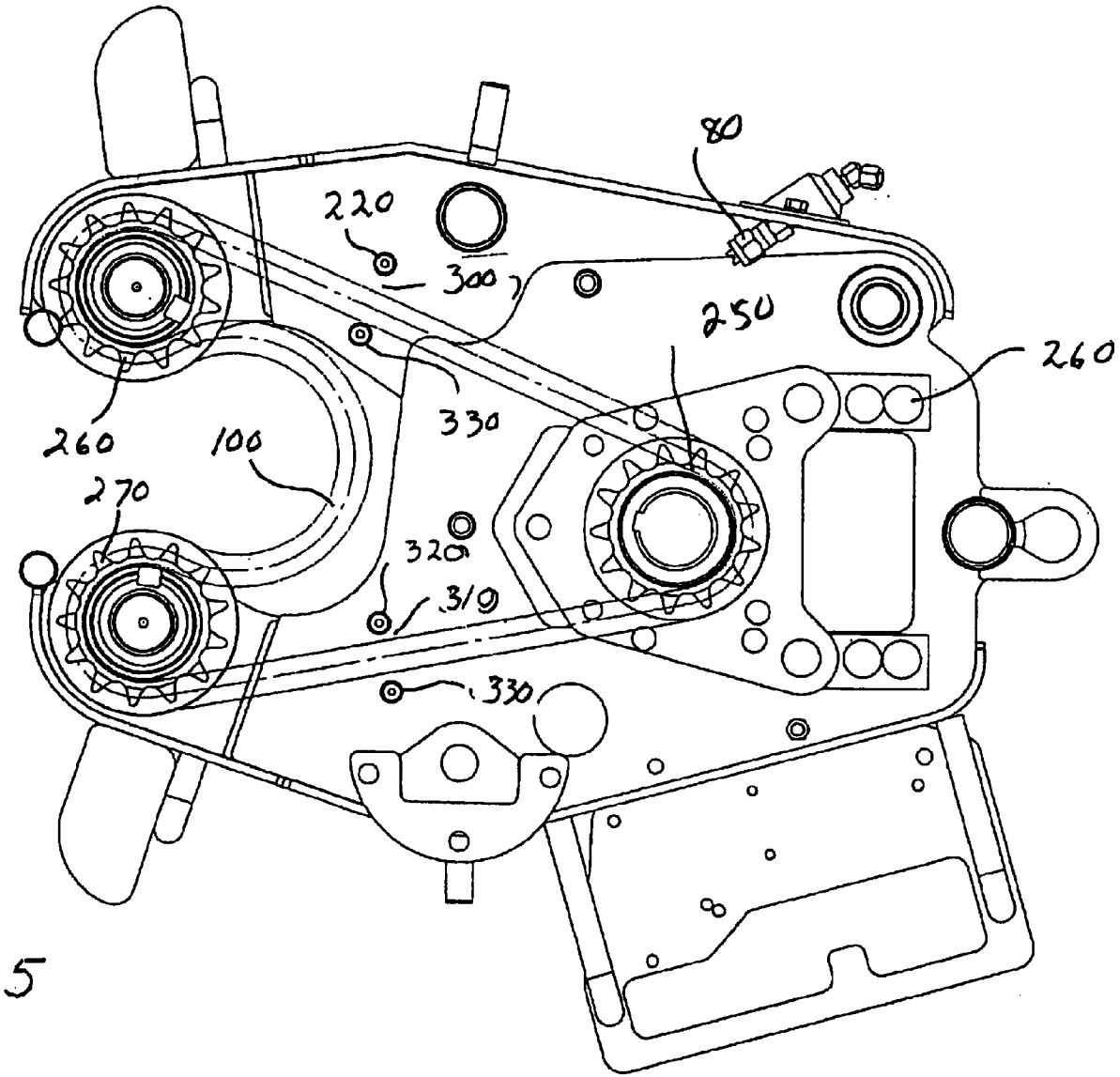
FIG. 5 is a top plan view of the spinner of FIG. 2 in an increased effective chain length position for larger pipe.
Figure 6:
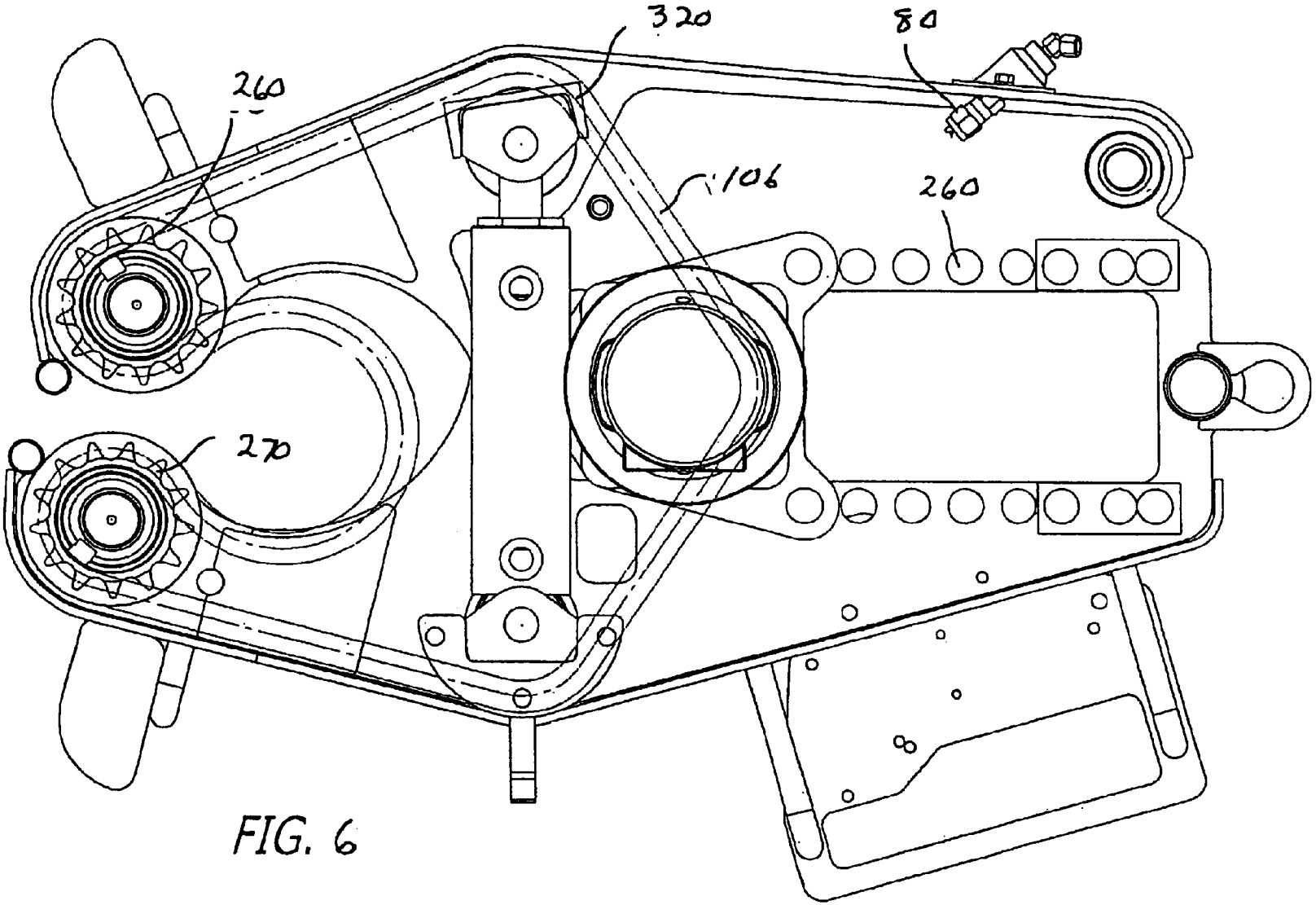
FIG. 6 is a view similar to FIG. 5, illustrating a larger embodiment thereof.
Figure 7:
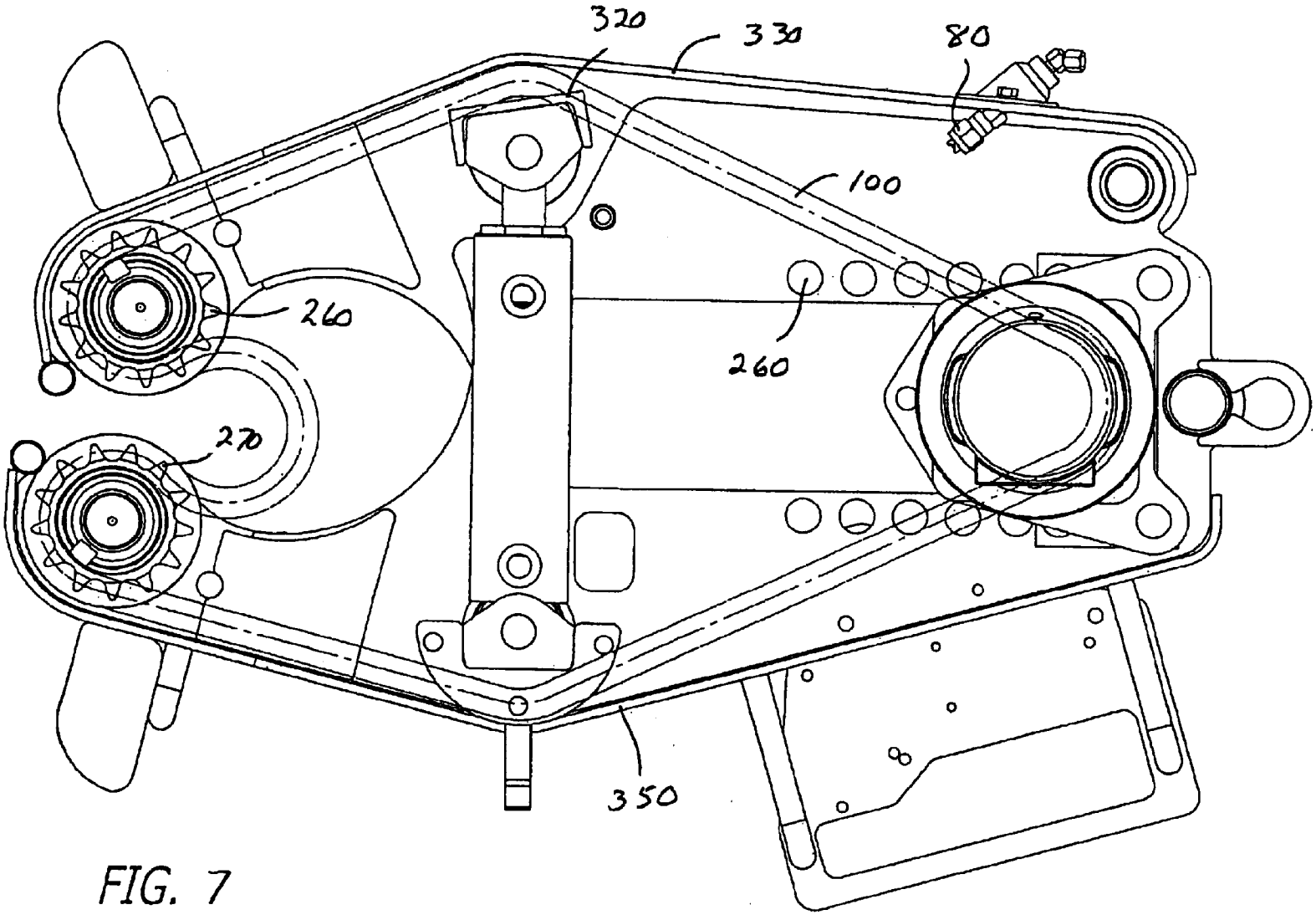
FIG. 7 is a view similar to FIG. 6, illustrating the spinner in a reduced effective chain-length condition for smaller pipe.
Figure 8:
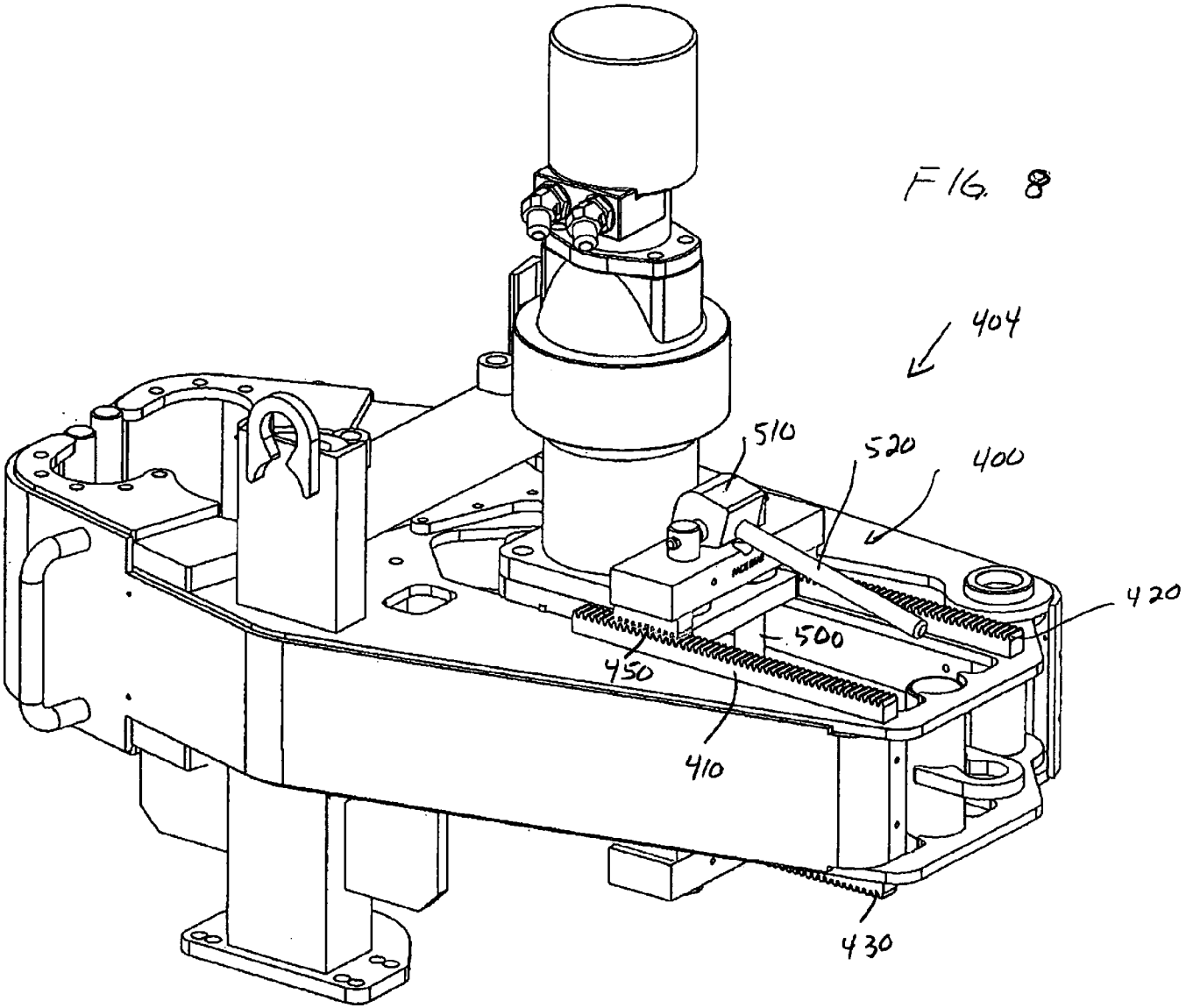
FIG. 8 is a top perspective view of an alternative chain spinner of the present invention and a variation of that of FIG. 1.
Figure 9:
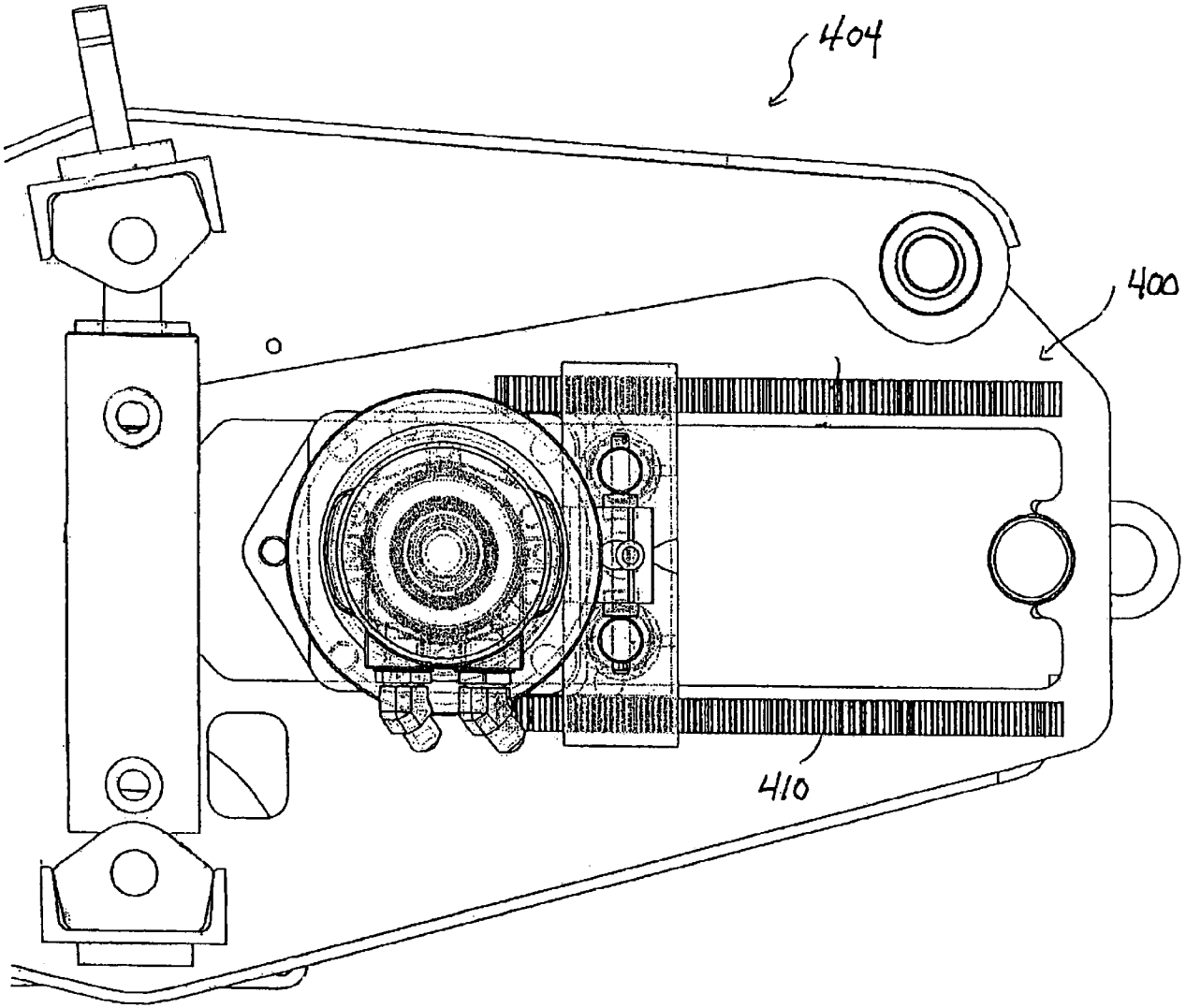
FIG. 9 is a top plan view of a portion of the spinner of FIG. 8.

Referring to FIGS. 5, 6 and 7 (and 3), for example, it can be seen that the nozzle 80 is proximate to the chain 100. An enlarged view of the nozzle 80 is provided in FIG. 4. The chain 100 can run in either direction, and as the chain is moving, the nozzle 80 can be spraying if the spray button 90 (FIG. 3) is pushed. The nozzle 80 is designed and positioned to spray a pattern of oil to cover all of the links of the chain 100 as it is moving by or translating past the spray nozzle head. The sprayed oil coats the chain 100 and seeps into the chain pins and links, thereby efficiently lubricating them.

The present onboard spraying system allows the chain 100 to be lubricated, for example, on a daily basis before the operator starts to spin the pipe and also to be lubricated at the end of the day before shutdown. It is anticipated that this effective, user-friendly lubrication system will double or triple the chain life. Additionally, it maintains spinner power, because when a chain starts corroding, the power of the spinner to torque the pipe is reduced.

The oiler only works when the spinner motor 70 is pressurized, as previously stated. Specifically, the oiler valve will not shift and allow oil to come up into the spray nozzle 80 and spray on the chain unless the motor is pressurized. The fluid flows out of the hydraulic system—out the spray nozzle 80 onto the chain as the motor is turning. It is powered by fluid going through the spinner motor 70. The nozzle is spraying the hydraulic fluid, which comes from the power unit tank (which has about one hundred gallons capacity). It only sprays for about a second and a half and applies one-twentieth of a gallon for each spray. The user may spray once a day or once a week, for example.

Thus, as long as the spinner motor 70 is pressurized, oil can be sprayed. When the chain oiler button 90 is pushed, lubricating oil is sprayed on the spinner chain 100, with the pressure for spraying the oil provided by the running motor. This makes for an efficient oil spraying because the chain 100 is then moving during the spraying operation and the oil can be evenly deposited over the entire length of the chain.

The present oiler system is advantageous because oil is not sprayed on a stationary chain. The oiler button is only effective when the chain is moving so that the spray can cover the entire chain 100 with a coating of oil as it is operating. If the chain 100 is not moving while the oil is being sprayed on it, the oil will just drip down and ineffectively/inefficiently lubricate and will tend to exhaust the oil supply. The fluid that is sprayed can be the hydraulic fluid of the HAWKJAW apparatus, the SPINMASTER apparatus, the power unit of the HAWKJAW apparatus or the rig unit.

The chain oiling system can be incorporated on the hydraulic block for the HAWKJAW apparatus. It has a manifold with a triggering valve that takes oil from the spinner valve only when the spinner is running. When the motor is rotating and the spinner chain 100 is thereby moving, the oil is sprayed using spinner motor oil pressure. When the spinner motor 70 is not seeing oil, it does not have the pressure on it and it is not rotating the chain, and there is thus no pressure on the oiling system. The button can be pressed but there is no pressure available to spray on the chain because the motor is not running. In other words, the motor pressure forced in the fluid is used to spray the oil on the chain. The spray will be approximately a forty-five degree (or larger) angle spray, and can be adjusted to effectively coat the chain.

An air-piloted hydraulic two-way valve is screwed into the manifold underneath the spinner valve assembly that operates the motor. It only takes the fluid that is under pressure, only when the spinner motor is activated, and dispenses it to a hose that runs to the spray head nozzle of the spinner. As stated above, the spinner chain must be moving before the oiler button will work, according to the preferred embodiment.

The chain 100 is a continuous chain driven by a hydraulic motor 70 via a drive sprocket 250. Referring to the drawings and looking down on the spinner, if it is moving in a clockwise direction, it is spinning the pipe out; and if it is moving in the opposite direction, it is spinning it in. The SPINMASTER spinner has a manual adjustment procedure for adjusting it so that the chain runs at a different effective length to accommodate different sizes of pipe. A plurality of holes 260 are provided defining different positions for the drive unit, and pins are then inserted through the unit into the desired holes to position the drive unit in the desired position. The pins can be pulled out and the unit pulled back to the most rearward holes whereby the chain size can handle pipes from 3½ to 9½ inches.

If this prior art spinner were run without a pipe in it, the chain would tend to get piled up on the slack side. The driven sprockets 260, 270 at the ends of the pivotally-mounted casing arms 280, 290 would grab the slack chain, and the torque of the spinner would pull the chain through into the side panel and rip the side panel out. The chain would bind up and tear the unit apart.

To solve this problem, one or more guide "windows" 300, 310 can be constructed on the unit pursuant to the present invention. The windows 300, 310 prevent the chain 100 from getting bound up and twisted. Thus, the chain does not get grabbed by the sprockets 260, 270 and tend to rip the side panel off. The windows 300, 310 can be formed by a pair of spaced posts 320, 330, such as shown in FIG. 5 for the smaller version that holds pipe up to 5½ inch diameter, or by a post structure 340 and a housing side wall 350, such as shown in FIGS. 6 and 7, for the larger version that runs up to 9½ inch diameter pipe.

With the windows 300, 310 provided and the spinner motor 240 turned on and without any pipe being run, the chain 100 will freewheel through the windows and not bind and get caught up in the sprockets. It is a type of tracking mechanism to make sure the chain 100 stays in the appropriate position and condition before it reaches the sprockets. The windows 300, 310 thereby keep the chain from getting tangled up.

As shown in the drawings, the effective length of the chain on the pipe can be adjusted by repositioning the drive assembly (or more particularly the drive sprocket) relative to the pipe (or the driven sprockets) by repositioning the support plate in different holes 260. The repositioning is used to accommodate pipes of different diameters, to compensate for chain "stretch" as the chain wears, and to adjust the chain gripping tension on the pipe. The holes 260 are about an inch apart. However, a finer adjustment than one inch is often desirable or needed. Also, some users may find operation of the hole and pin adjustment system to be a bit cumbersome.

Accordingly, provided herein is a novel cam-operated rack-on-rack adjustment assembly shown generally at 400 (as part of a chain spinner 404) in lieu of the above-described hole and pin adjustment system. The rack-on-rack assembly 400 provides for one-quarter inch adjustment or even finer adjustments if the rack gear pitch is smaller. Additionally, the cam operability thereof is user friendly.

Referring to FIGS. 8–12, the rack-on-rack adjustment assembly 400 includes an upper pair of fixed racks 410, 420, a lower pair of fixed racks 430, 440, an upper pair of movable racks 450, 460, and a lower pair of movable racks 470, 480, connected by vertical guide rods 500.

Figure 10:
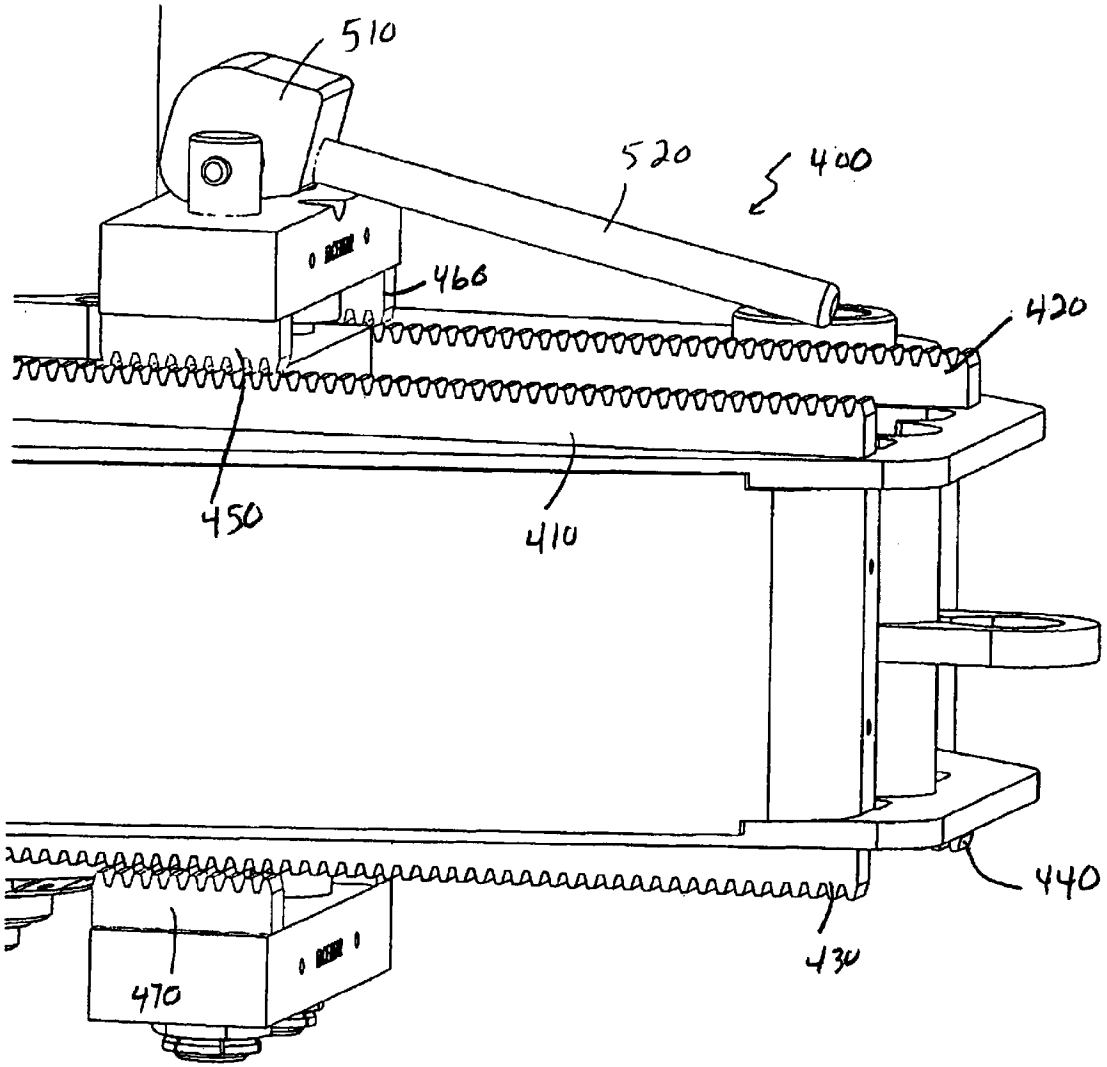
FIG. 10 is a side elevational view of the right portion of the spinner of FIG. 8.
Figure 11:
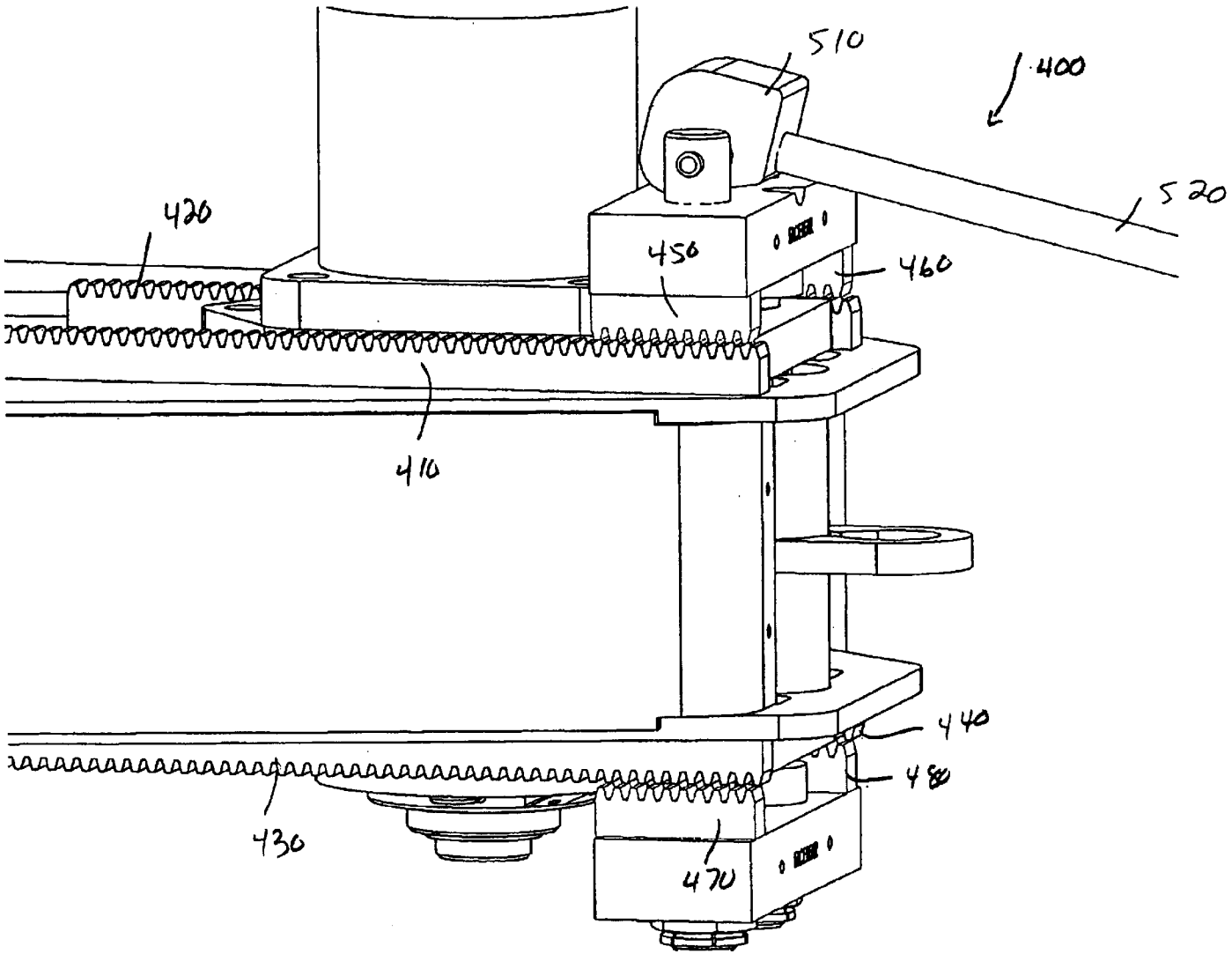
FIG. 11 is a view similar to FIG. 10 showing the spinner in a second condition for smaller pipe.
Figure 12:
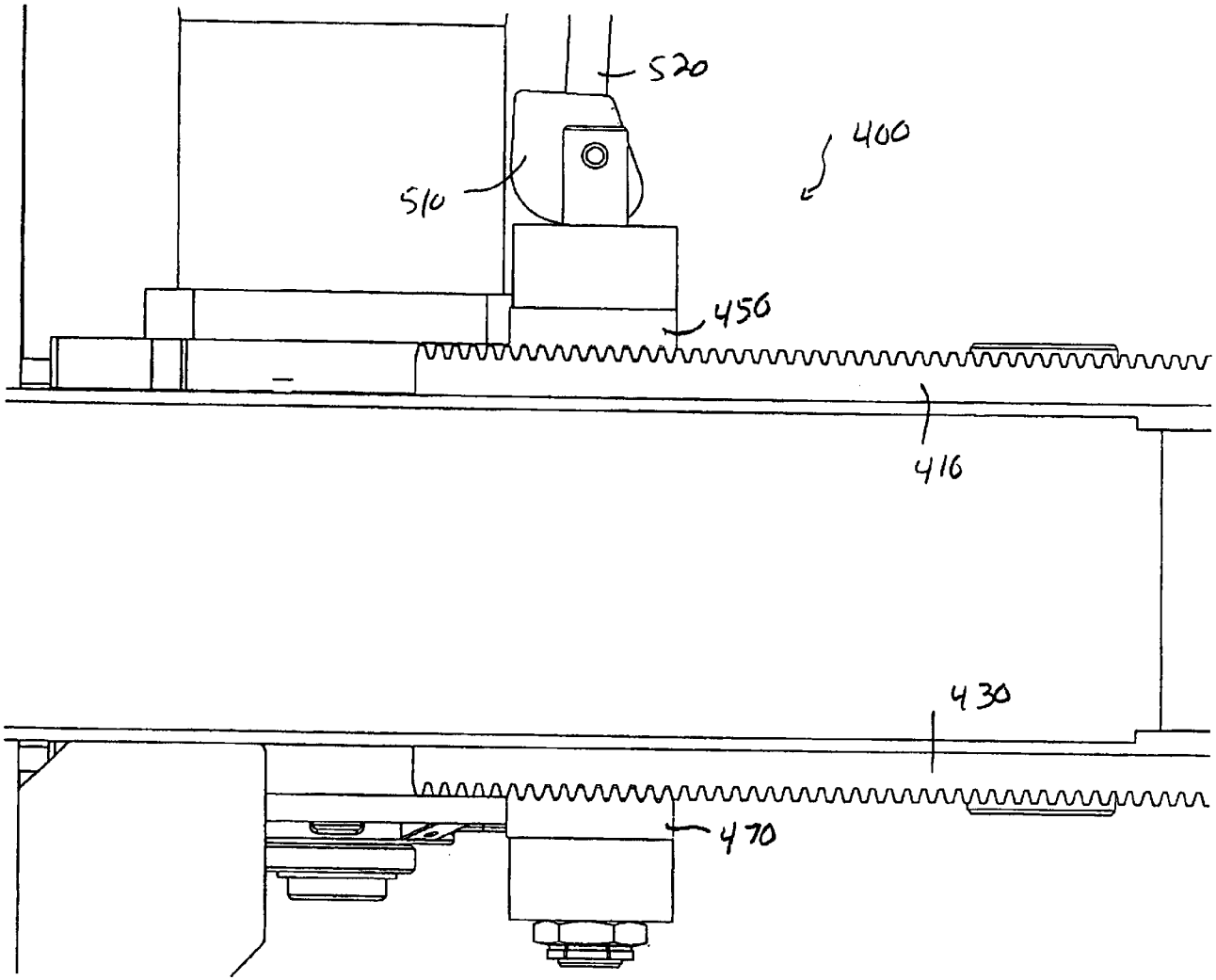
FIG. 12 is a side elevational view of FIG. 10 showing the spinner in a cam-locked position.

A cam member 510 is pivotal about a perpendicular axis by moving an engagement lever 520 up and down. When the lever 480 is in an up position, as shown in FIG. 12, for example, the movable racks are engaged locked, against their respective fixed racks. When the lever 520 is in a down position, the movable racks are disengaged from the fixed racks in an unlocked position as depicted in FIGS. 10 and 11. When in the unlocked position the drive assembly 530 can be moved relative to the fixed racks to change the effective chain engagement length. (It can be slid parallel to the fixed racks on four Teflon bearing slides.) When the drive sprocket is in the new desired position (and thereby the movable racks are in their new positions relative to the fixed racks), the lever 520 is moved up to lock the movable racks in the new position (by the engaging teeth). Since the cam 510 moves past its center position, the cam will not slip out of the locked position.

Figure 13:
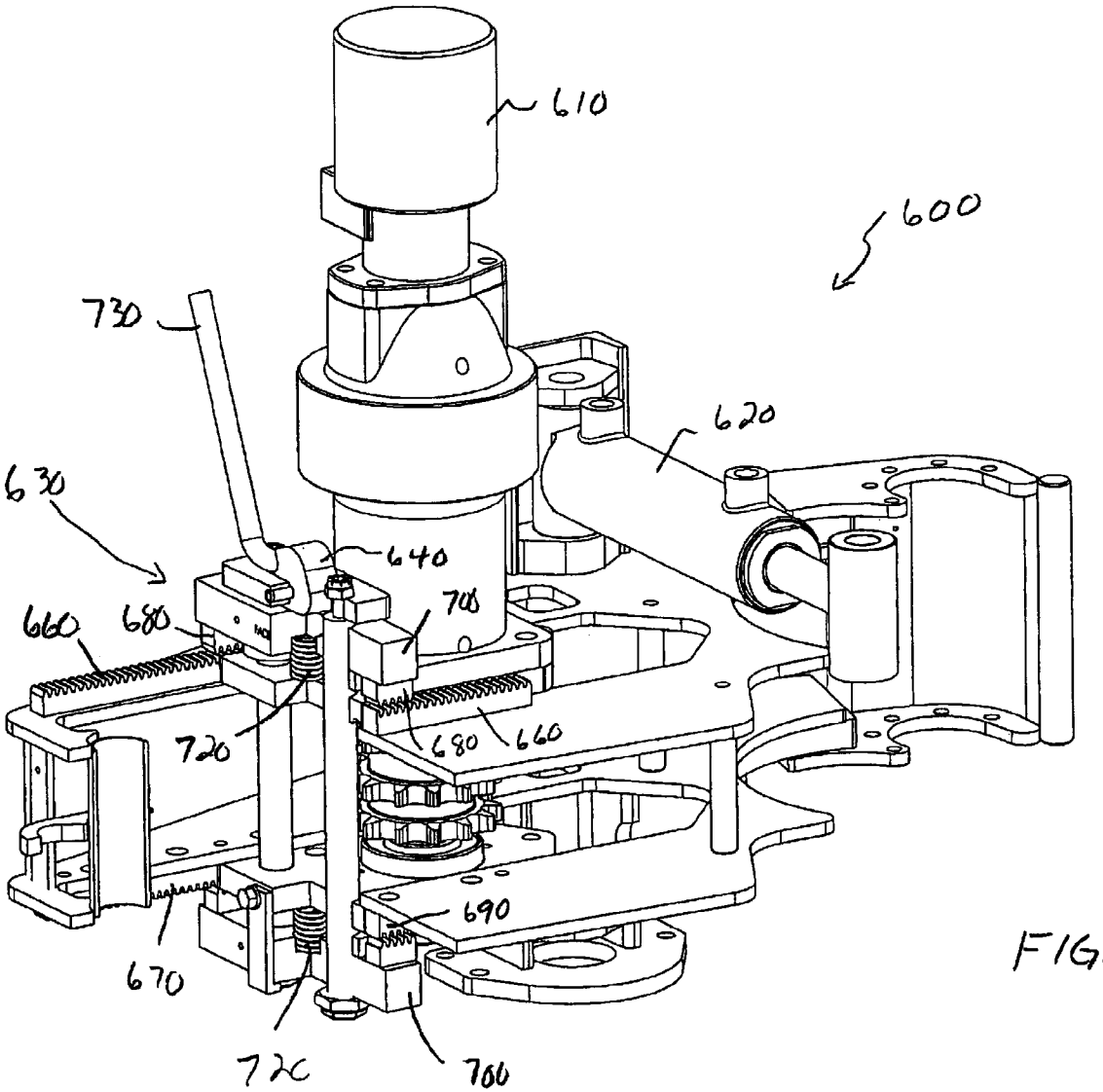
FIG. 13 is a perspective view of a chain spinner of the present invention which is a variation of the chain spinner of FIG. 8 and is illustrated in an un-locked position ready for drive reposition; portions of the view are broken away for illustrative purposes.
Figure 14:
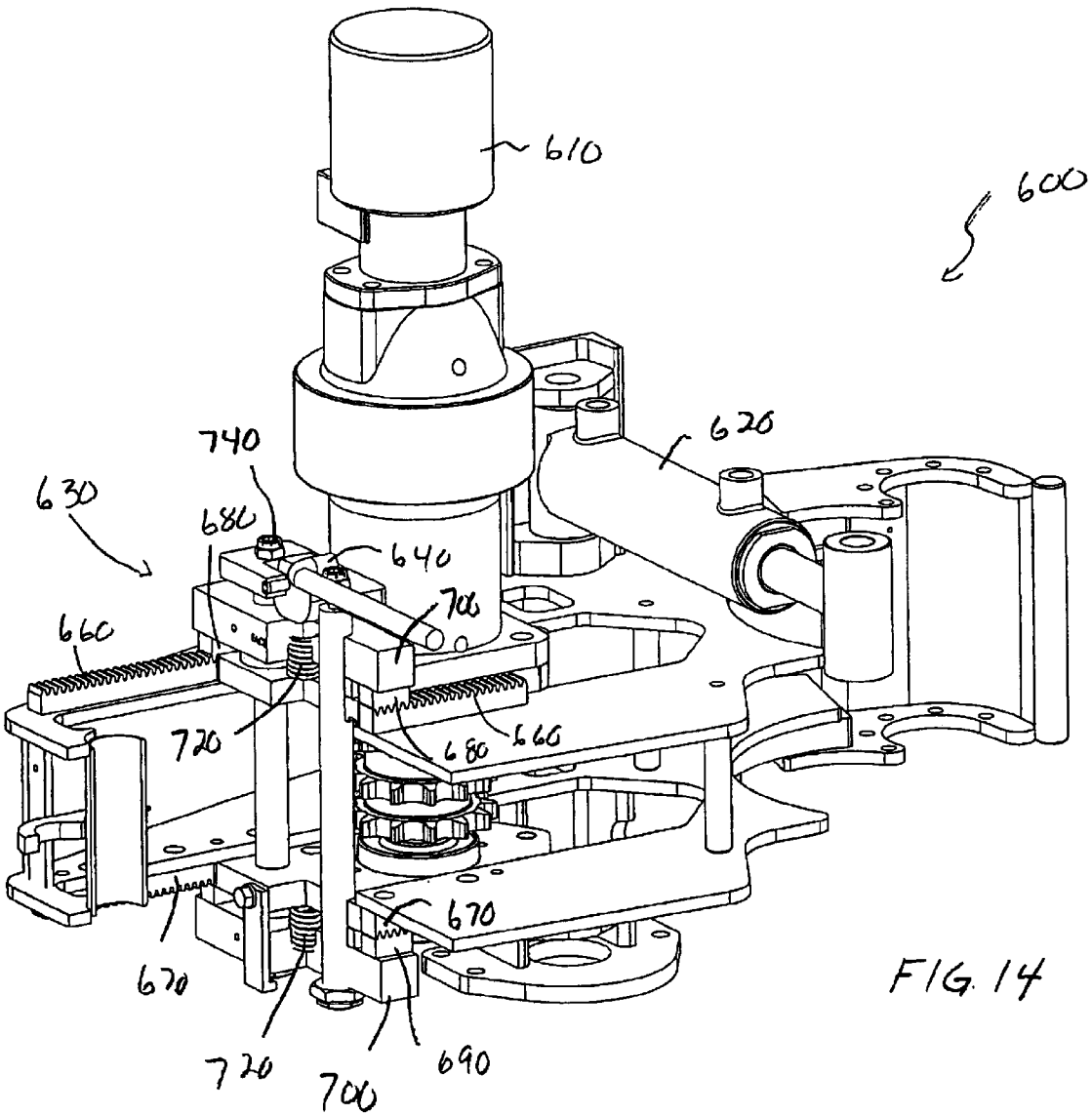
FIG. 14 is a view similar to FIG. 13 with the spinner illustrated in a cam-locked position.
Figure 15:
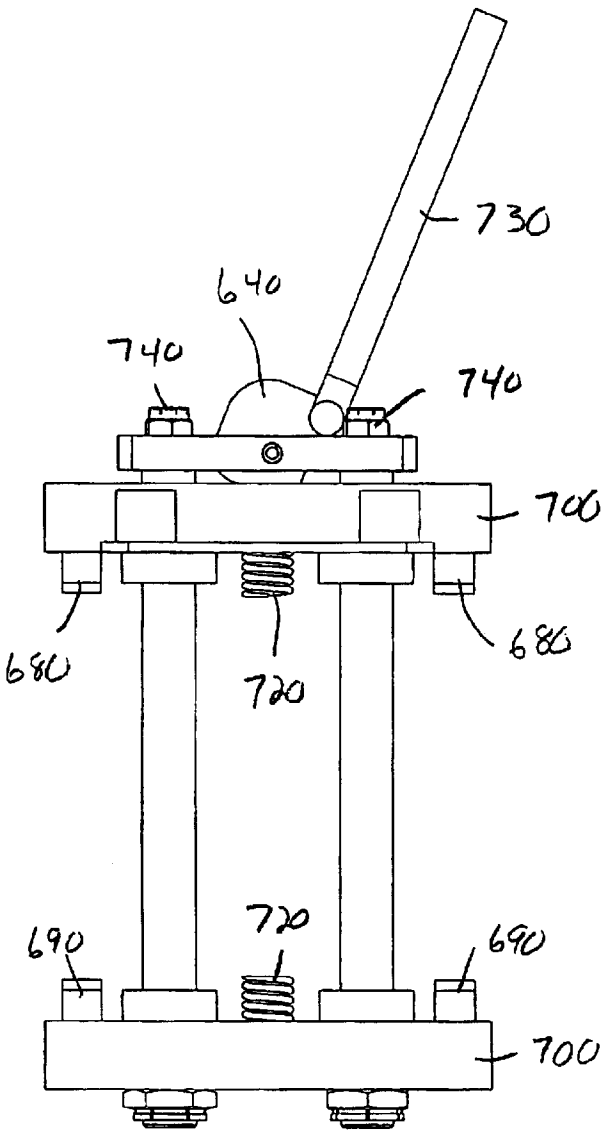
FIG. 15 is an end view of the cam-operated rack-on-rack assembly of the spinner of FIG. 13, illustrated in isolation.

When the rack-on-rack assembly 400 is in a rearward position (away from the pipe) and the engagement lever 520 is in a down position (see FIG. 11), the lever sticks out behind the machine in a vulnerable position. Accordingly, a variation of the present invention provides for the lever to pivot about a parallel instead of a perpendicular axis. Thereby the lever goes to a side (instead of the back) when in a down position. This variation is illustrated in FIGS. 13 and 14 generally at 600. And shown in FIGS. 13–16 are the drive motor 610, clamping cylinder 620, rack-on-rack assembly 630, activating cam 640, guide rods 650, fixed racks 660, 670, movable racks 680, 690, movable rack blocks 700, disengagement springs 720, lever 730, and bolts 740.

Figure 16:
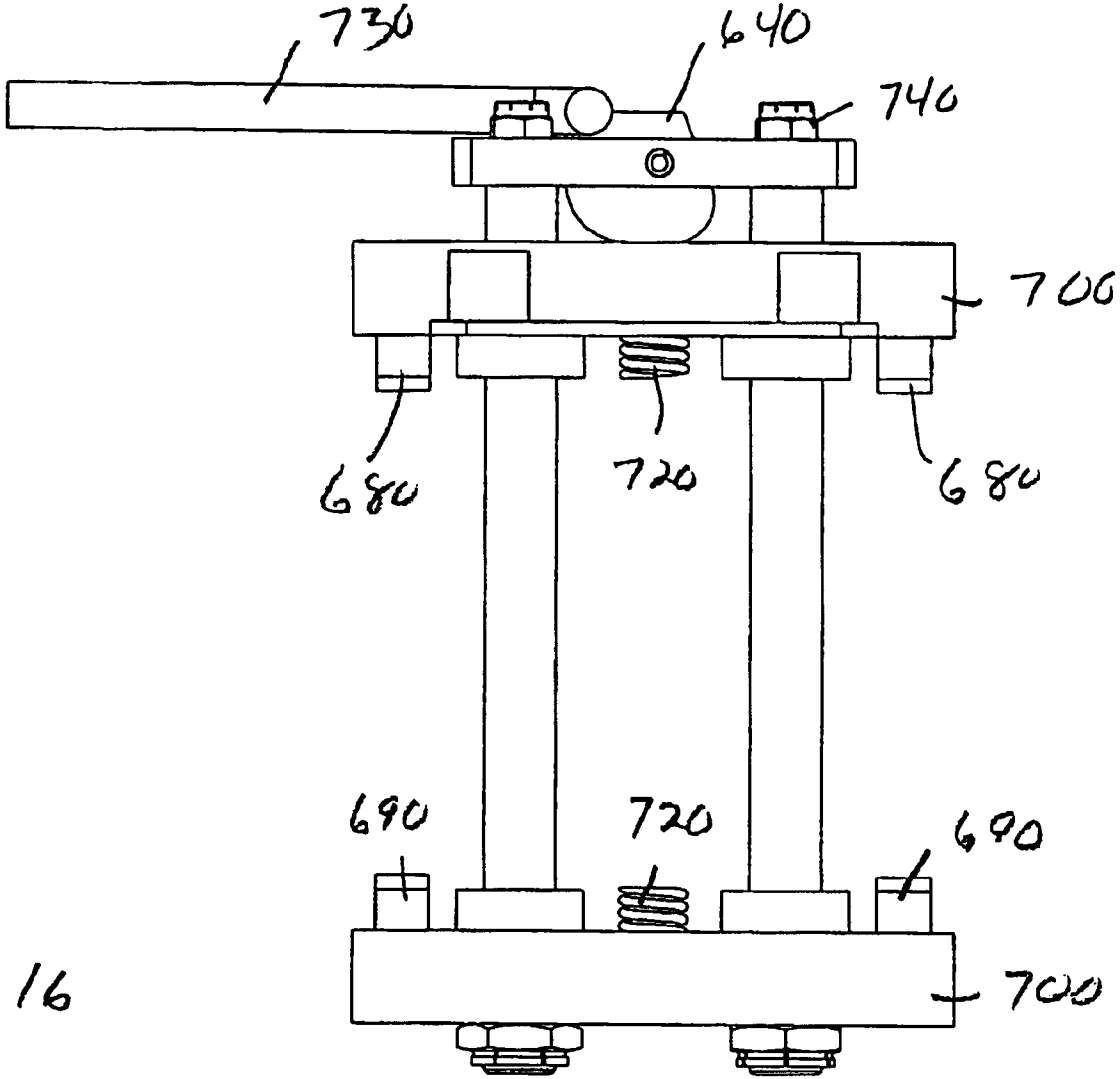
FIG. 16 is an end view of the cam-operated rack-on-rack assembly of FIG. 14, illustrated in isolation.

The rack-on-rack assembly 700 is shown in its unlocked position in FIG. 14 and in isolation in FIG. 16. And this assembly is shown in its locked position in FIG. 13 and in isolation in FIG. 15.

The following are some usable specifications of the components of the chain spinner 404. The drive chain has eighty-eight links and one inch pitch. The stationary and movable racks have lengths of twelve and two and one-half inches, respectively. Pipes having diameters from 2⅞ to 9½ inches can be rotated at speeds of seventy to one hundred and thirty revolutions per minute by the spinner. The drive motor can be a Parker Hydraulic Motor TG O14O MS0 30AAAB. Components with other specifications as needed and/or as would be apparent to those skilled in the art are included herein.

From the foregoing detailed description, it will be evident that there are a number of changes, adaptations and modifications of the present invention that come within the province of those skilled in the art. The scope of the invention includes any combination of the elements from the different species, embodiments, functions and/or subassemblies disclosed herein, as would be within the skill of the art. However, it is intended that all such variations not departing from the spirit of the inventions be considered as within the scope thereof.

What is claimed is:

1. A tubular-element rotating assembly, comprising:

a chain drive assembly;

a continuous chain adapted to be driven by the chain drive assembly to contact and rotate a tubular element; and a rack-on-rack assembly adapted to adjust an effective length of the chain which contacts the tubular element.

2. The assembly of claim 1 wherein the rack-on-rack assembly includes a fixed rack and a parallel movable rack movable between locked and unlocked positions relative to the fixed rack and when in the unlocked position movable longitudinally relative to the fixed rack to thereby adjust the effective length of the chain.

3. The assembly of claim 2 wherein the rack-on-rack assembly includes a locking-unlocking cam pivotal about a pivot axis.

4. The assembly of claim 3 wherein the pivot axis is parallel to the racks.

5. The assembly of claim 3 wherein the pivot axis is perpendicular to the racks.

6. The assembly of claim 3 wherein the rack-on-rack assembly includes a lever for pivoting the cam about the pivot axis.

7. A tubular-element rotating assembly, comprising:

a chain drive assembly;

a continuous chain adapted to be driven by the chain drive assembly to contact and rotate a tubular element; and a cam-operated assembly adapted to adjust an effective length of the chain which contacts the tubular element.

8. The assembly of claim 7 wherein the cam-operated assembly includes a cam member pivotal about a pivot axis, the chain drive assembly includes a drive unit, and to adjust the effective length of the chain, the cam-operated assembly moves the drive unit in a movement direction.

9. The assembly of claim 8 wherein the pivot axis is perpendicular to the movement direction.

10. The assembly of claim 8 wherein the pivot axis is parallel to the movement direction.

11. The assembly of claim 8 wherein the cam-operated assembly includes a lever for pivoting the cam member about the pivot axis.

12. A spinner chain adjustment method, comprising:

moving a chain-drive-sprocket rack relative to a chain-driven-sprocket rack from a first position to a second position; and cam locking the chain-drive-sprocket rack in the second position to the chain-driven-sprocket rack and thereby adjusting the effective tubular engaging length of a tubular spinner chain.

* * * * *